US005499043A

United States Patent [19]

Osaka

[11] Patent Number: 5,499,043

[45] Date of Patent: Mar. 12, 1996

[54] PORTABLE RECORDING APPARATUS WITH INCLUDED RECORDING UNIT

[75] Inventor: Tsutomu Osaka, Machida, Japan

[73] Assignee: Canon Kabushiki Kaisha, Tokyo, Japan

[21] Appl. No.: 942,803

[22] Filed: Sep. 10, 1992

[30] Foreign Application Priority Data

Sep. 19, 1991 [JP] Japan ..... 3-266932

[51] Int. Cl.[6] ..... B65H 29/00

[52] U.S. Cl. ..... 347/108; 346/145; 400/680; 400/691

[58] Field of Search ..... 400/88, 680, 685, 400/691; 346/140 R, 145, 134; 347/104, 108, 152, 222, 263; 355/21, 200

[56] References Cited

U.S. PATENT DOCUMENTS 4,893,137 1/1990 Ebinuma et al. ..... 347/108

FOREIGN PATENT DOCUMENTS 62-56174 3/1987 Japan ..... 400/691
1-208171 8/1989 Japan ..... 400/691

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A recording apparatus includes a recording unit and a sheet feeding unit. The recording unit includes a conveying unit for conveying a sheet so as to move along a sheet conveying path substantially orthogonal to a lower surface of the unit, a recording device disposed along the sheet conveying path for performing recording on the sheet, a discharging unit for discharging the sheet on which recording has been performed by the recording device, and a tray for mounting the sheet discharged by the discharging unit. The sheet feeding unit supports the recording unit and includes a feeding unit for feeding the sheet to the sheet conveying path, and a support for supporting the recording unit so as to incline the sheet conveying path.

21 Claims, 12 Drawing Sheets

PORTABLE RECORDING APPARATUS WITH INCLUDED RECORDING UNIT

BACKGROUND OF THE INVENTION

1. Field of the Invention

This invention relates to a recording apparatus which records on a recording sheet, and more particularly, to a recording apparatus which includes a detachable sheet-material feeding unit.

2. Description of the Related Art

A portable printer having the shape shown in FIG. 10 has been proposed as a transportable recording apparatus. The printer may, for example, be used in a horizontal state or in a vertical state, and is relatively small in size.

In FIG. 10, reference numeral 50 represents the above-described portable printer. When the printer 50 is not used, an outer cover 50*b* is superposed above an inner cover 50*a*. Thus, the printer 50 becomes so compact that the user can carry it in a dedicated bag. Hence, such a printer has excellent transportability and portability.

As shown in FIG. 11, the printer 50 incorporates a recording unit comprising a recording head 51 for performing recording on a recording sheet S, a platen roller 52 for conveying the recording sheet S while supporting it, and a discharging unit comprising a discharging roller 53 having a circumferential speed slightly higher than that of the platen roller 52, and a spur 54 which is rotatingly driven by the discharging roller 53.

The printer 50 also includes a detachable automatic sheet feeder 55 for automatically feeding the recording sheets S, serving as sheet materials.

The recording sheets S set in the automatic sheet feeder 55 are individually separated by a pickup roller 56, and each of the separated sheets S is conveyed in an obliquely upward direction toward the recording unit of the printer 80. Recording is performed on the recording sheet S conveyed between the recording head 51 and the platen roller 52, which constitute the recording unit. Recording head 51 records while the recording sheet S is supported by the platen roller 52. The recording sheet S is then discharged onto the outer cover 50*b*, which also serves as a discharge tray, by the discharging roller 53 and the spur 54.

However, in the above-described conventional printer having the configuration shown in FIG. 11, since the recording unit, comprising the recording head 51 and the platen roller 52, and the discharging unit, comprising the discharging roller 53 and the spur 54, are disposed in an inclined state, the size of the printer increases, whereby transportability which is the greatest advantage of such a printer is impaired.

For the purpose of providing a small apparatus, a printer having the configuration shown in FIG. 12 has been proposed. In FIG. 12 the same reference numerals as used in FIGS. 10 and 11 correspond to the same components. In such a printer 50, the above-described recording unit and discharging unit are disposed so as to be substantially perpendicular to the mounting surface of the printer. Hence, when the recording sheet S is fed from the automatic sheet feeder 55 to the printer 50, the recording sheet S is curved with a steep angle, and is therefore apt to have a peculiar habit of being curled. In addition, since after a recording operation, the recording sheet S is discharged in a direction substantially perpendicular to the mounting surface of the apparatus, the discharged recording sheet S cannot be stacked on the outer cover 50*b*.

SUMMARY OF THE INVENTION

The present invention has been made in consideration of the above-described problems in the prior art.

It is an object of the present invention to provide a recording apparatus in which a sheet material, after a recording operation, is securely discharged onto a discharge tray, and the operability and visibility of the apparatus are improved.

This object is accomplished, according to one aspect of the present invention, by a recording apparatus provided with a recording unit and a detachable automatic sheet-material feeding unit, wherein inclining means for inclining the recording unit is provided so that a sheet-material conveying path within the recording unit has a predetermined angle.

In an aspect of the present invention there is provided a recording apparatus having a recording unit and a sheet feeding unit supporting the recording unit. The recording unit has a conveying means for conveying a sheet received from the sheet feeding unit along a sheet feeding path substantially orthogonal to a lower surface of the recording unit, a recording means, a discharging means for discharging the sheet on which recording has been performed and a tray for mounting the sheet discharged by the discharging means. The sheet feeding unit has a feeding means for feeding the sheet from the sheet feeding unit to the sheet conveying path in the recording unit and a supporting means for supporting the recording unit so as to incline the sheet conveying path.

In addition, an operation/display unit for inputting information to the recording apparatus is disposed so as to be inclined in a direction reverse to the inclination of the recording unit.

According to the present invention, since the inclining means for inclining the recording unit is provided so that the sheet-material conveying path within the recording unit is inclined, a sheet material can be smoothly fed from the automatic sheet-material feeding unit to the recording unit, and the sheet material after a recording operation is securely discharged onto the discharge tray.

Furthermore, by inclining the operation/display unit of the recording unit in a direction reverse to the inclination of the recording unit, the operability and visibility of the apparatus are improved.

BRIEF DESCRIPTION OF THE DRAWINGS

FIG. 8 is a sectional side view of a recording apparatus according to a modification of the third embodiment;

DETAILED DESCRIPTION OF THE PREFERRED EMBODIMENTS

An explanation will now be provided of recording apparatuses, each provided with an automatic sheet-material feeding unit, according to the preferred embodiments of the present invention and with reference to the drawings.

First Embodiment

Figure 1:
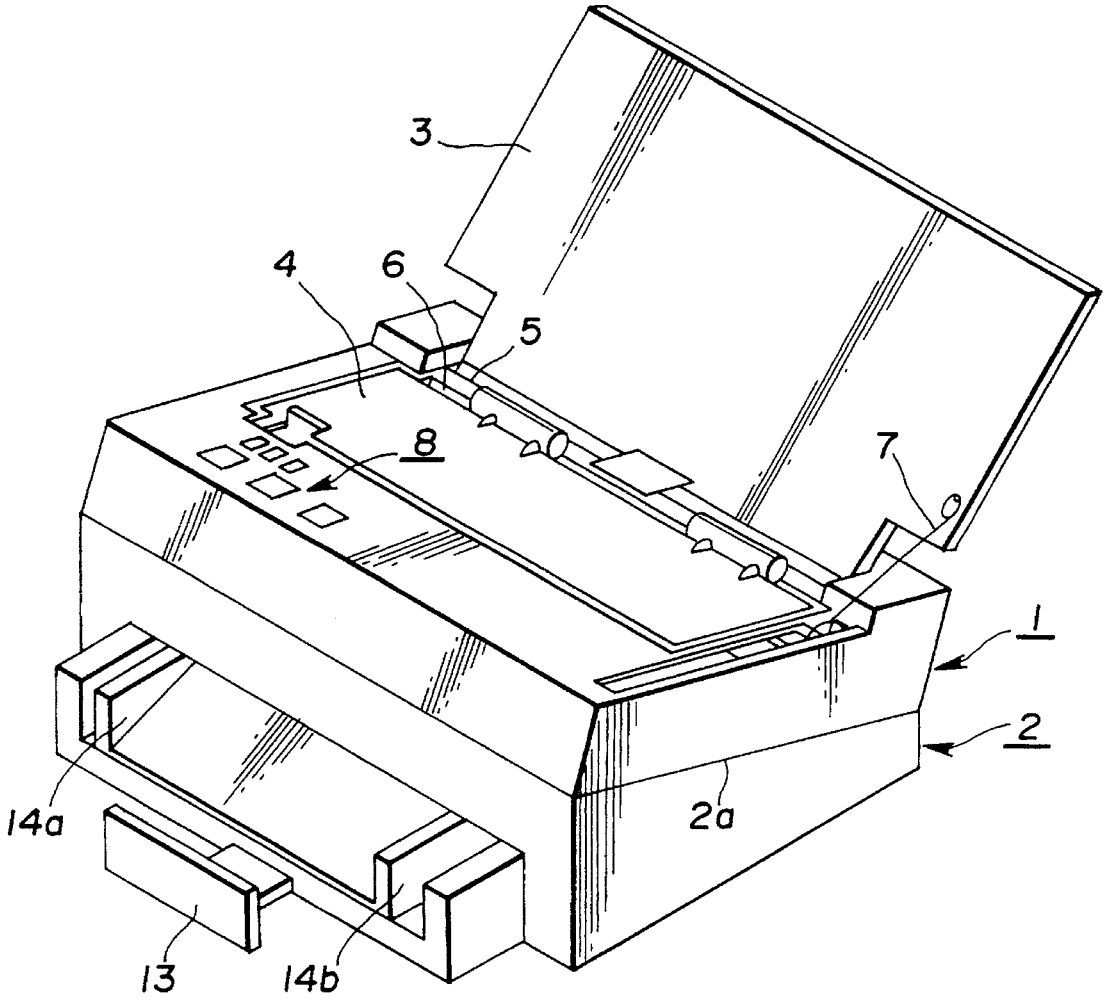
FIG. 1 is a perspective view showing an external appearance of a recording apparatus provided with an automatic sheet-material feeding unit having an inclined surface according to a first embodiment of the present invention.
Figure 2:
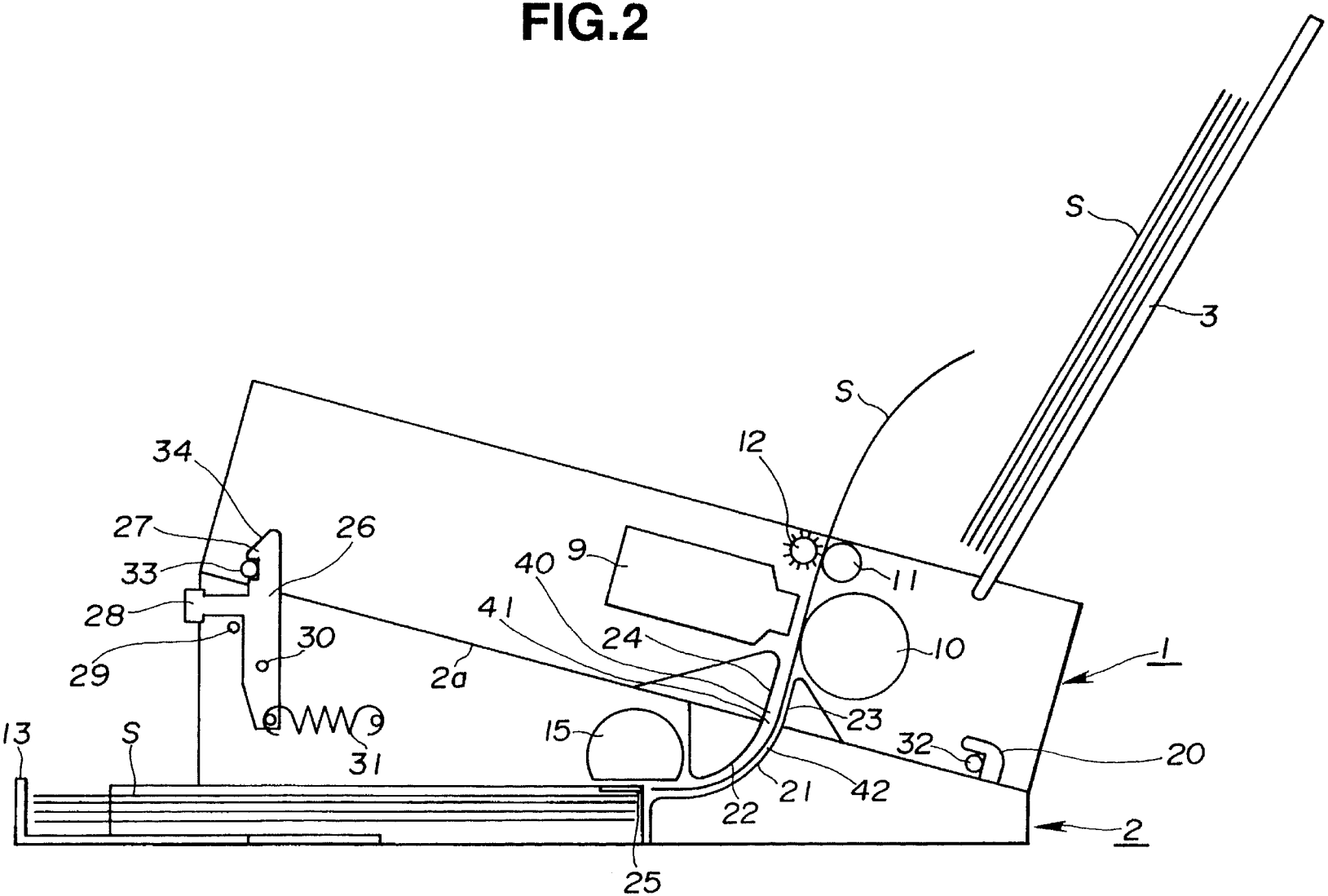
FIG. 2 is sectional side view of the recording apparatus shown in FIG. 1.

FIG. 1 is a perspective view showing an external appearance of a recording apparatus provided with an automatic sheet-material feeding unit according to a first embodiment of the present invention. FIG. 2 is a sectional side view of the apparatus shown in FIG. 1.

In FIGS. 1 and 2, a recording apparatus for recording on a recording sheet S includes a recording unit 1 and a detachable automatic sheet-material feeding unit 2 for automatic feeding of the recording sheet S.

The recording unit 1 also includes an outer cover 3 and an inner cover 4. When the unit 1 is not used, the outer cover 3 is superposed above the inner cover 4, whereby the recording unit 1 becomes compact. The user, for example, can carry the recording apparatus while accommodating it within a dedicated bag. Hence, such a recording apparatus has excellent transportability and portability.

For mounting the automatic sheet-material feeding unit 2 to the recording unit 1, a hook 20 of the automatic feeding unit 2 is engaged with a pin 32 of the recording unit 1. If the front-end portion of the recording unit 1 is downwardly pressed in this state, a pin 33 provided on the recording unit 1 contacts a cam surface 34 of a hook lever 26 to rotate the hook lever 26 in a clockwise direction around a fulcrum 30 against the tension of a spring 31. When the pin 33 passes through the cam surface 34, the hook lever 26 is rotated in a counterclockwise direction around the fulcrum 30 by the tension of the spring 31, whereby the pin 33 engages a hook 27.

For detaching the automatic feeding unit 2 from the recording unit 1, a button 28 is manually pushed to rotate the hook lever 26 in a clockwise direction, whereby the engagement between the pin 33 and the hook 27 is released. If the front-end portion (the end at which hook lever 26 is located) of the recording apparatus 1 is raised while the button 28 is depressed, the pin 33 is detached from the hook 27. Subsequently, if the recording apparatus 1 is forwardly moved (to the left as viewed in FIG. 2), the engagement between the pin 32 and the hook 20 is also released, whereby the automatic feeding unit 2 is detached from the recording unit 1. The hook lever 26 contacts a stopper 29 and is thereby stopped.

The outer cover 3 can also function as a feeding guide for the recording sheet S when the cover 3 is opened. In such a case, an opening indicated by reference numeral 5 serves as an insertion port. The outer cover 3 can also function as a discharge tray. In such a case, an opening indicated by reference numeral 6 serves as a discharge port. A hook 7 fixes the position of the outer cover 3 when the outer cover 3 is opened and is used as the feeding guide or as the discharge tray. An operation/display unit 8 of the recording unit 1 inputs commands from the operator and information on settings and the like for the recording apparatus, and also displays information to the operator.

As shown in FIG. 2, the recording unit 1 incorporates a recording means comprising a recording head 9 for recording on the recording sheet S and a platen roller 10 for conveying the recording sheet S while supporting it. Recording unit 1 also includes a discharging unit comprising a discharging roller 11 having a circumferential speed slightly higher than that of the platen roller 10 and a spur 12 which is rotatingly driven by the discharging roller 11.

An opening 41 leading to paper path 40 is formed in the base of the recording unit 1. Paper path 40 is for guiding the recording sheet S toward a space between the platen roller 10 and the recording head 9. The paper path 40 is formed from guides 23 and 24.

The recording head 9 is a bubble-jet type in which ink bubbles are generated within a nozzle filled with ink by thermal energy, and liquid drops of ink are discharged onto a sheet by expansion of the bubbles.

As described above, the automatic sheet-material feeding unit 2 automatically feeds the recording sheet S, serving as the sheet material, to the recording unit 1, and holds the recording sheets S accommodated in the automatic sheet-material feeding unit 2. A longitudinal adjuster 13 adjusts the amount of space in the longitudinal direction of the recording sheets S, and lateral adjusters 14*a* and 14*b* for adjust for different widths of recording sheets S (see FIG. 1).

Guide members 21 and 22 form a paper path 42 at the side of the automatic sheet-material feeding unit 2.

The automatic sheet-material feeding unit 2 is provided with an inclined surface 2*a* which serves as an inclining means for reducing the angle made when the recording sheet S is fed to the recording unit 1. The recording apparatus is mounted on inclined surface 2*a*.

Next, the operation of the present apparatus will be explained. The recording sheets S are stored in a horizontal state within the automatic sheet-material feeding unit 2. The recording sheets S are individually separated by counterclockwise rotation of a pickup roller 15, and each of the separated sheets S is fed through path 42 to the recording unit 1 of the recording apparatus. Reference numeral 25 represents a separation pawl. Recording is performed on the recording sheet S fed between the recording head 9 and the platen roller 10, constituting the recording unit, by the recording head 9 provided at a position facing the platen roller 10 while the recording sheet S is supported by the platen roller 10. Subsequently, the recording sheet S is discharged outside the apparatus by the discharging roller 11 and the spur 12 constituting the discharging unit via the discharge port 6. At that time, since the recording unit 1 is inclined by being mounted on the inclined surface 2*a* of the automatic sheet-material feeding unit 2, the recording sheet S is stably discharged onto the outer cover 3 which serves as the discharge tray.

Figure 3:
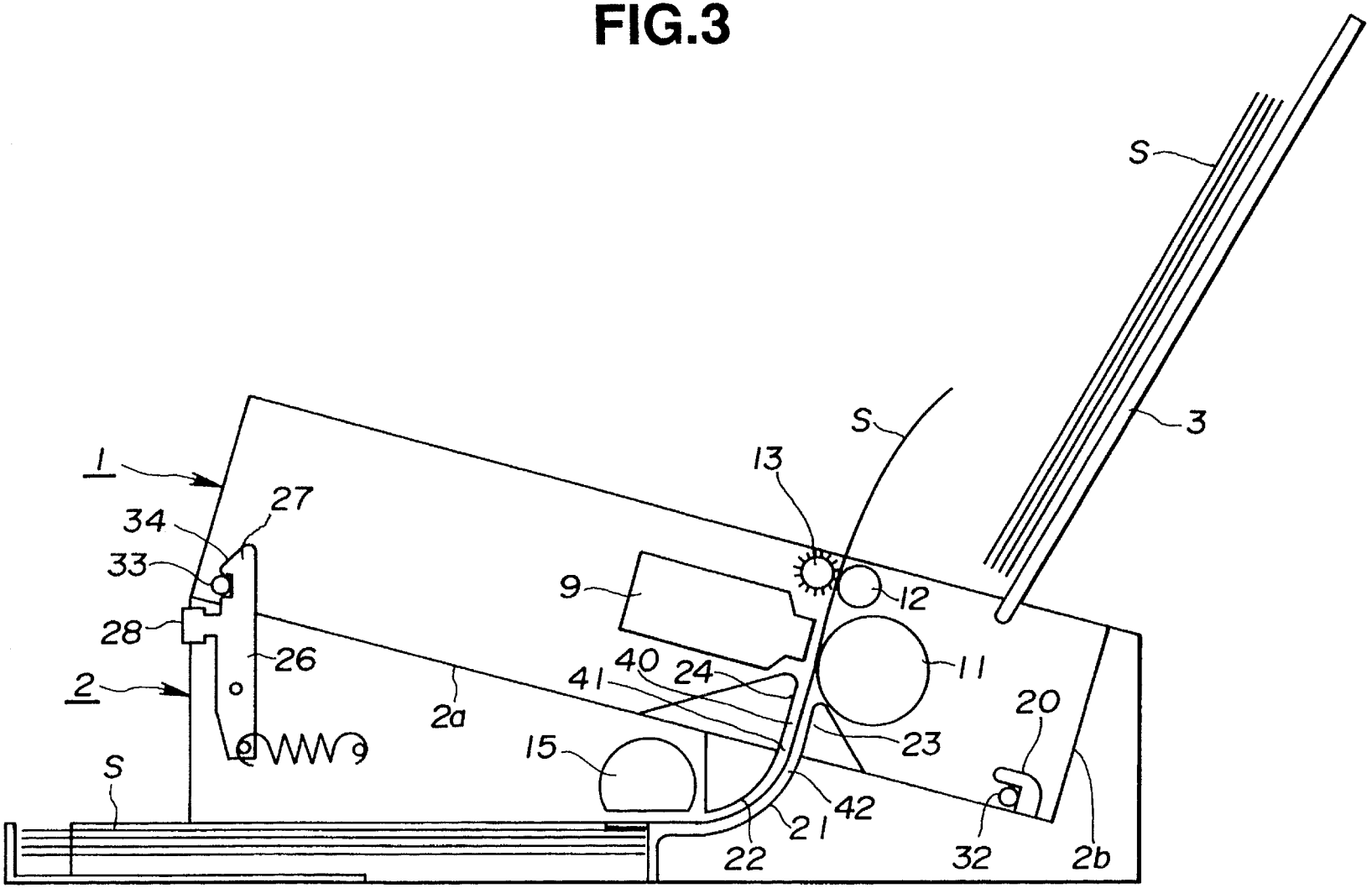
FIG. 3 is a sectional side view of a recording apparatus in accordance with a modification of the first embodiment of the present invention provided with an automatic sheet-material feeding unit having a surface perpendicular to the inclined surface.

As shown in FIG. 3, in order to improve operability when detaching the automatic sheet-material feeding unit 2, a plane 2b (having an angle of 90°–120° with respect to the inclined surface 2a) which is substantially perpendicular to the inclined surface 2a of the automatic sheet-material feeding unit 2 may be provided at a rear portion of the unit 2. By positioning the recording unit 1 against the perpendicular plane 2b while pressing, it is possible to improve operability when detaching the unit 2.

Second Embodiment

Figure 4:
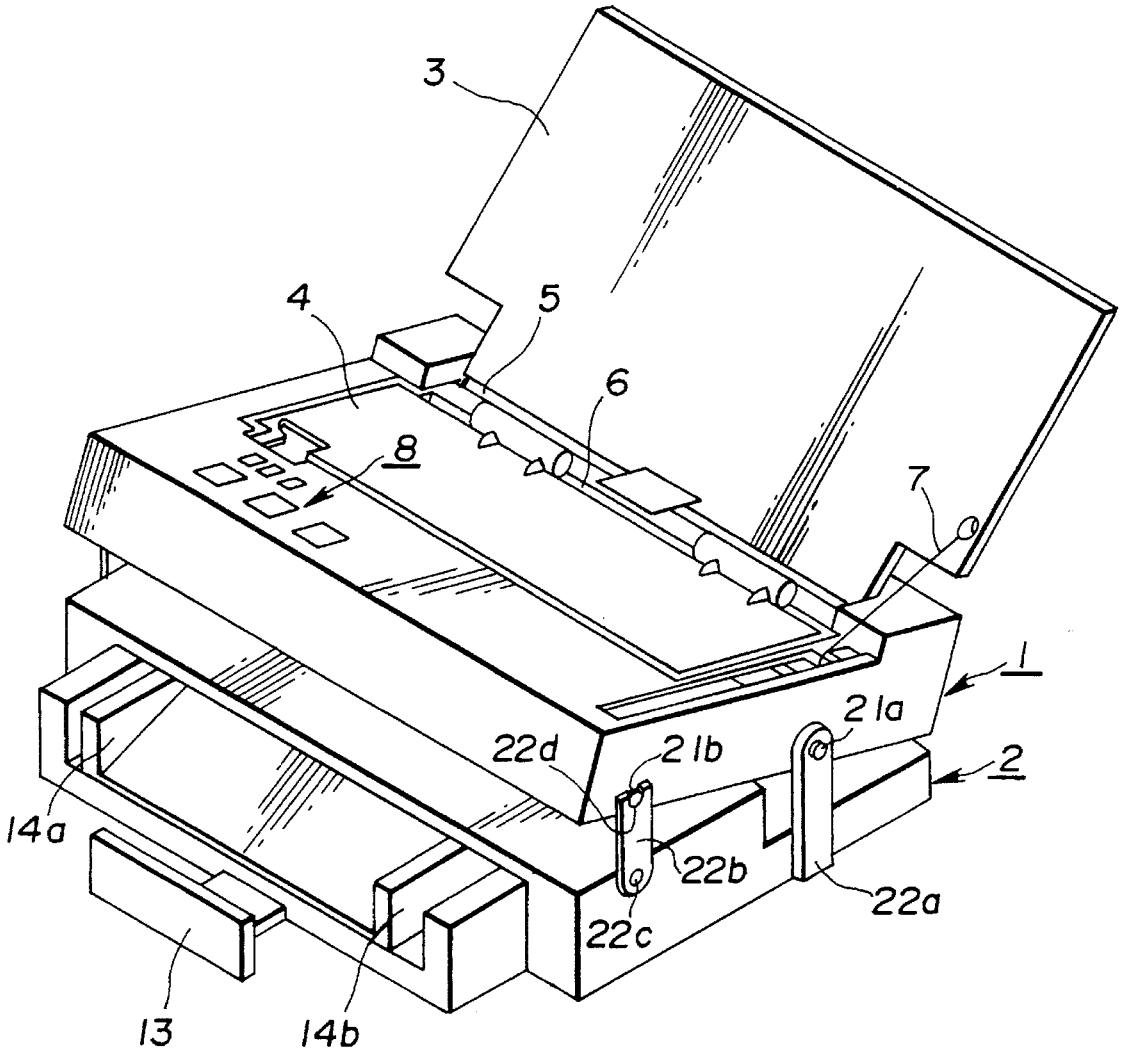
FIG. 4 is a perspective view showing a state in which a recording apparatus according to a second embodiment of the present invention is used (during a recording operation)
Figure 5:
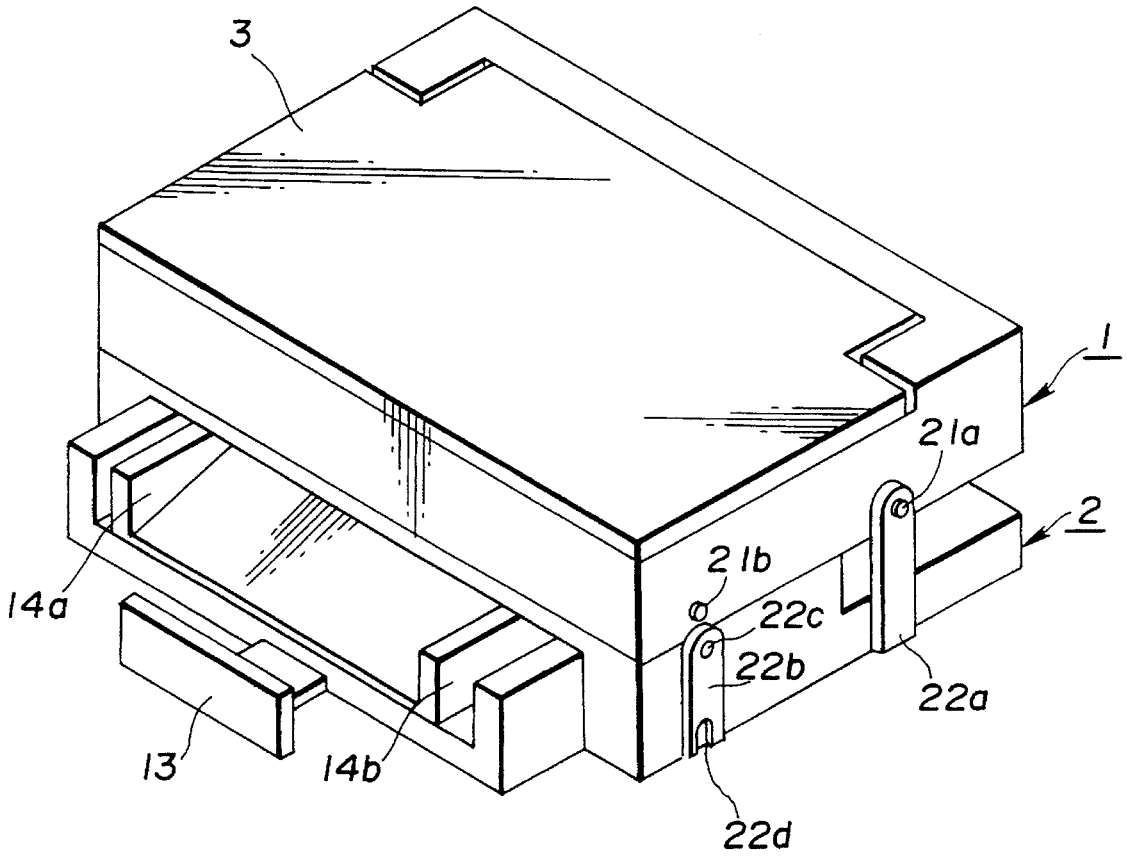
FIG. 5 is a perspective view showing a state in which the recording apparatus of the second embodiment is not used (when the apparatus is accommodated)

An explanation will now be provided of a recording apparatus according to a second embodiment of the present invention with reference to FIGS. 4 and 5. Although the overall configuration is substantially the same as in the first embodiment, the configuration of the inclining means for reducing the angle made when the recording sheet is fed from the automatic sheet-material feeding unit to the recording apparatus differs. Hence, the configuration of the inclining means will be hereinafter described in detail. The same components as those in the first embodiment are indicated by the same reference numerals.

FIG. 4 is a perspective view showing a state in which the recording apparatus of the second embodiment is used (in a recording operation). FIG. 5 is a perspective view of the recording apparatus of the second embodiment when the apparatus is not used (in an accommodated state).

In FIG. 4, an end portion of a boss 22a fixed to the automatic sheet-material feeding unit 2 is mounted on a rotation shaft 21a provided in the recording apparatus 1. The recording unit 1 is rotatable around the rotation shaft 21a. One end of a lever 22b is rotatably mounted on a rotation shaft 22c provided in the automatic sheet-material feeding unit 2. A groove 22d is provided at the other end of the lever 22b. By hooking a dowel 21b provided in the recording apparatus 1 in the groove 22d, the recording unit 1 is held in an inclined state, in which the recording unit 1 is used (in a recording operation), as shown in FIG. 4.

Once in the inclined state shown in FIG. 4, if the groove 22d of the lever 22b is detached from the dowel 21b, and the outer cover 3 is closed so as to be superposed above the inner cover 4, the recording apparatus is in a nonusable state (in an accommodated state) as shown in FIG. 5, whereby the entire apparatus becomes compact. Hence, it is possible to improve the transportability and portability of the apparatus.

Although in the second embodiment, the lever 22b is used for preventing rotation of the recording unit 1, a link mechanism, a screw mechanism, a click mechanism or the like may also be provided. In addition, the angle of rotation of the apparatus may be adjusted according to the environment of the use or printing pattern.

Third Embodiment

As described above, while the recording apparatus 1 is inclined by the inclining means, the operation unit 8 of the recording unit 1 is also inclined. As shown in FIGS. 6 through 9, in a recording apparatus according to a third embodiment of the present invention, there is provided a means for securing the operability and visibility of the operation unit 8. Since the entire configuration of the apparatus is substantially the same as that of the recording apparatus of the first embodiment, only differences will be explained. The same components as those in the first embodiment are indicated by the same reference numerals.

Figure 6:
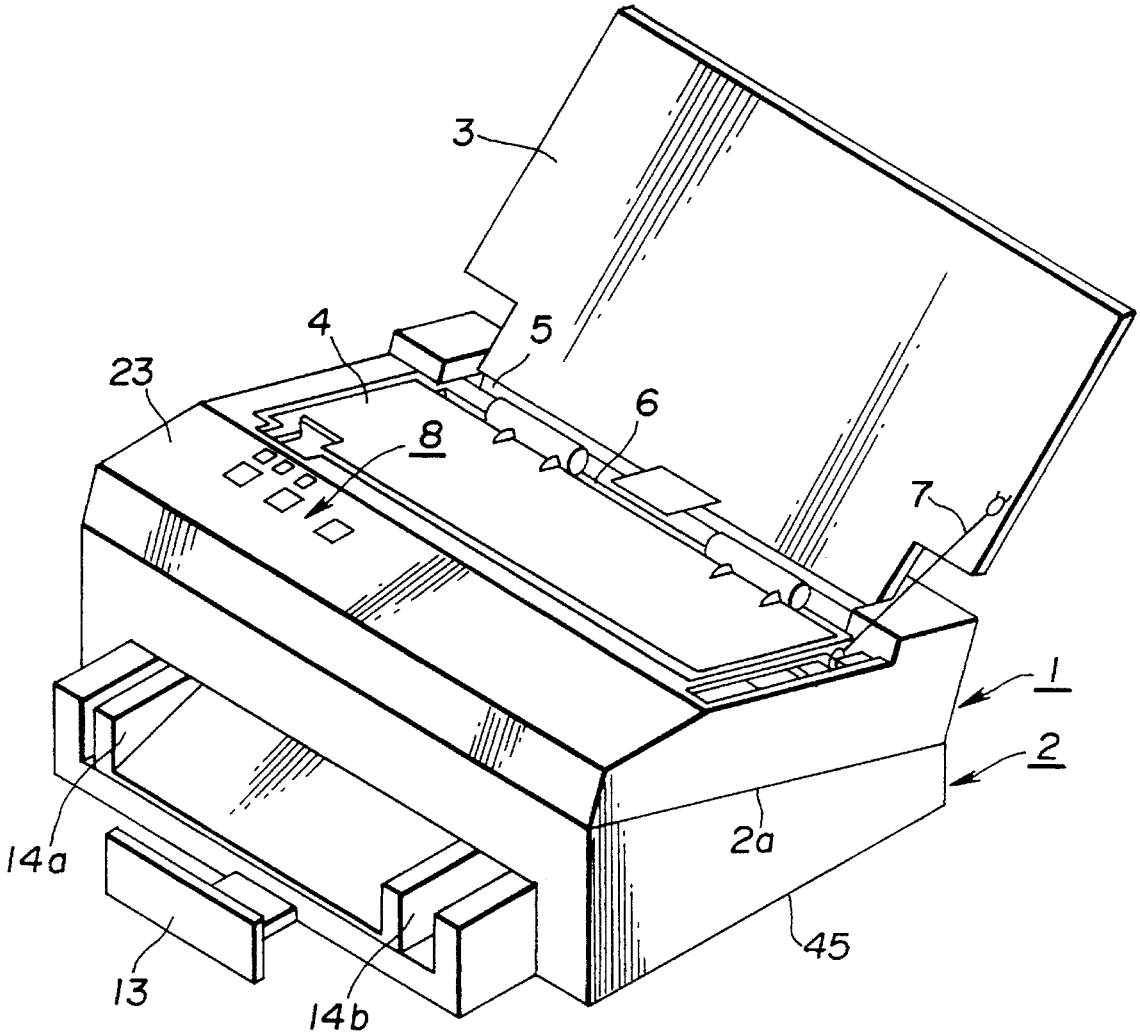
Figure 7:
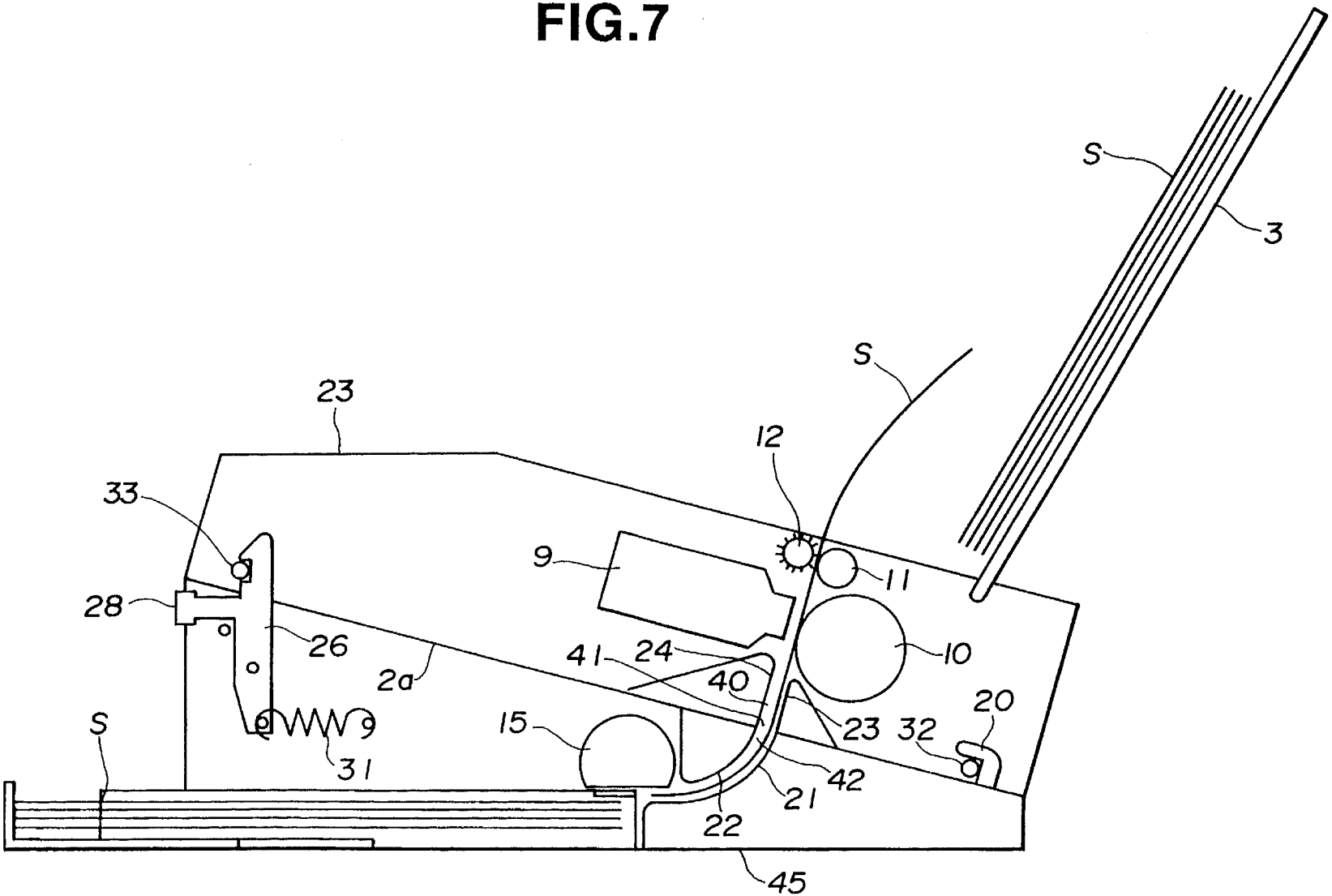
FIG. 7 is a sectional side view of a recording apparatus according to a third embodiment of the present invention.

FIG. 6 is a perspective view showing a state in which the recording apparatus of the present embodiment is used (in a recording operation). FIG. 7 is a sectional side view of the recording apparatus shown in FIG. 6.

As shown in FIGS. 6 and 7, the operation unit 8 is provided on a plane 23 having a predetermined angle which serves as the inclining means. The plane 23 is formed in an inclined state relative to inclined surface 2a so as to be parallel to the base 45 of the automatic sheet-material feeding unit 2. Accordingly, the operation unit 8 is horizontally placed in contrast to the inclined recording unit 1.

Figure 8:
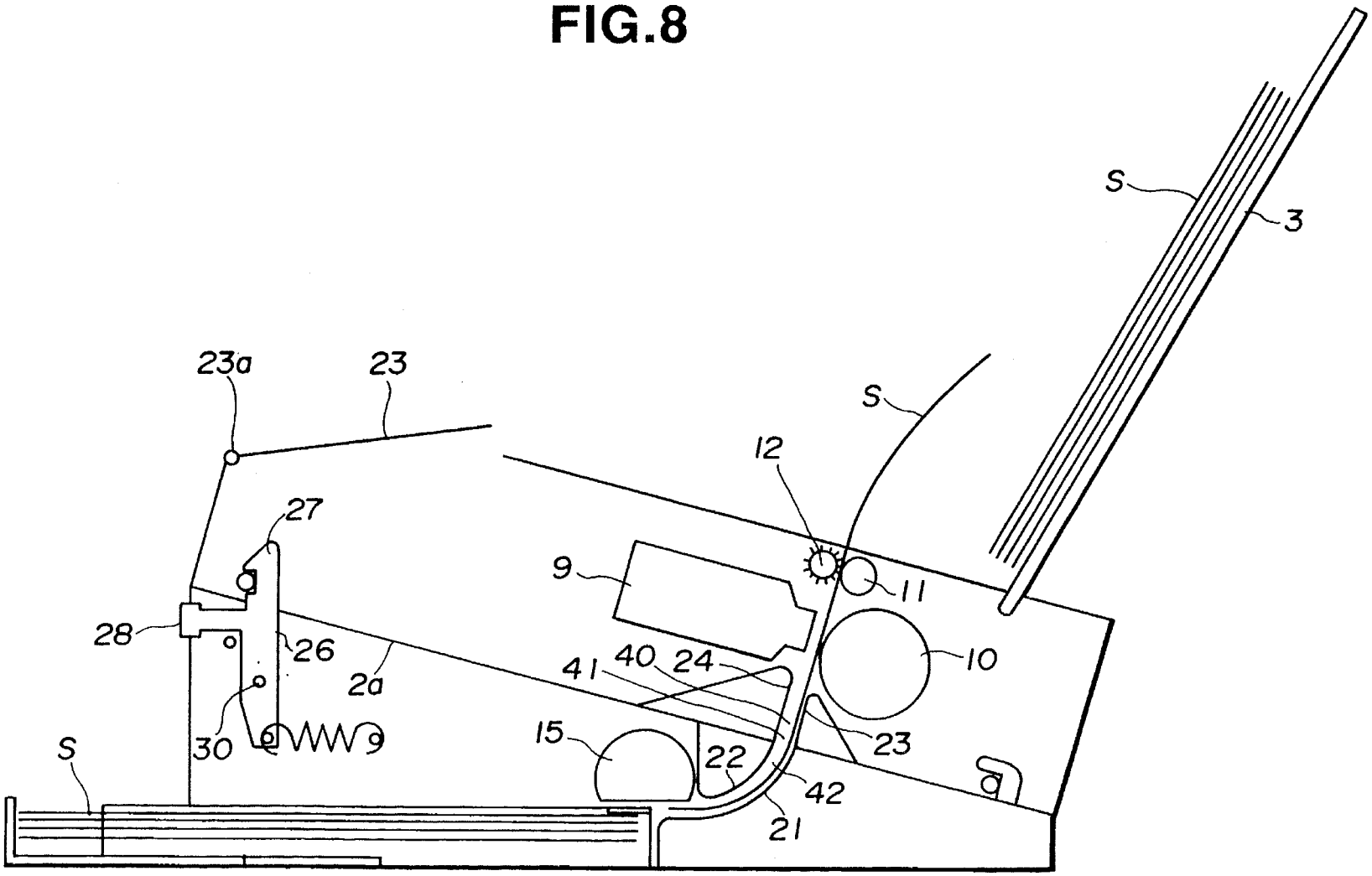
FIG. 8 is a perspective view showing a state in which a recording apparatus according to a third embodiment of the present invention is used (during a recording operation)

As shown in FIG. 8, a fulcrum 23a may be provided at one end of the plane 23 including the operation unit (input panel) 8 so that the plane 23 is rotatable around the fulcrum 23a. Thus, it is possible to arbitrarily adjust the angle of the operation unit 8, whereby the operability and visibility of the apparatus can be further improved. In addition, the friction of the fulcrum 23a may be utilized, or a screw mechanism or a click mechanism may be added to hold plane 23 at the selected angle.

Figure 9:
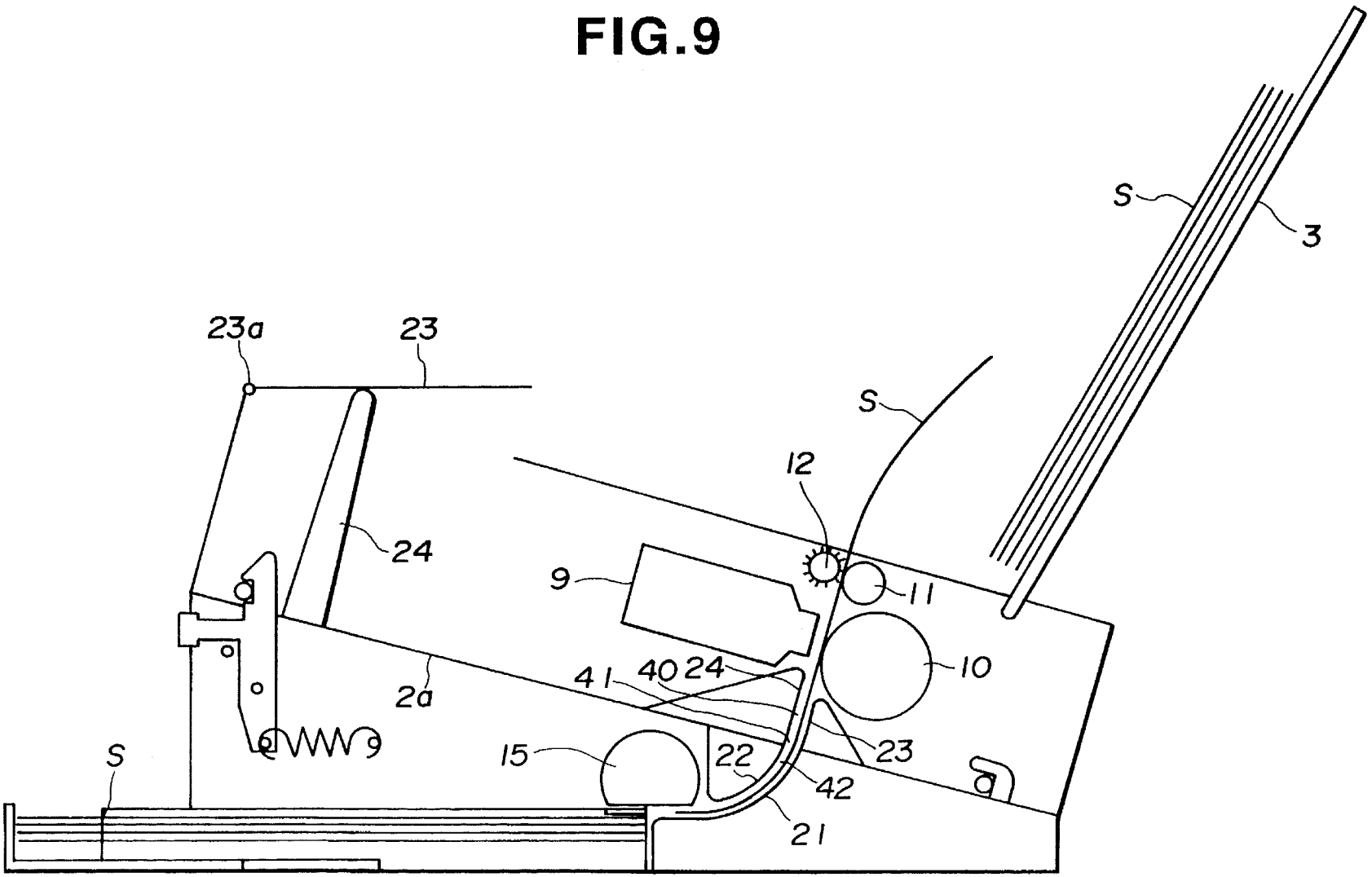
FIG. 9 is a sectional side view of a recording apparatus according to another modification of the third embodiment.
Figure 10:
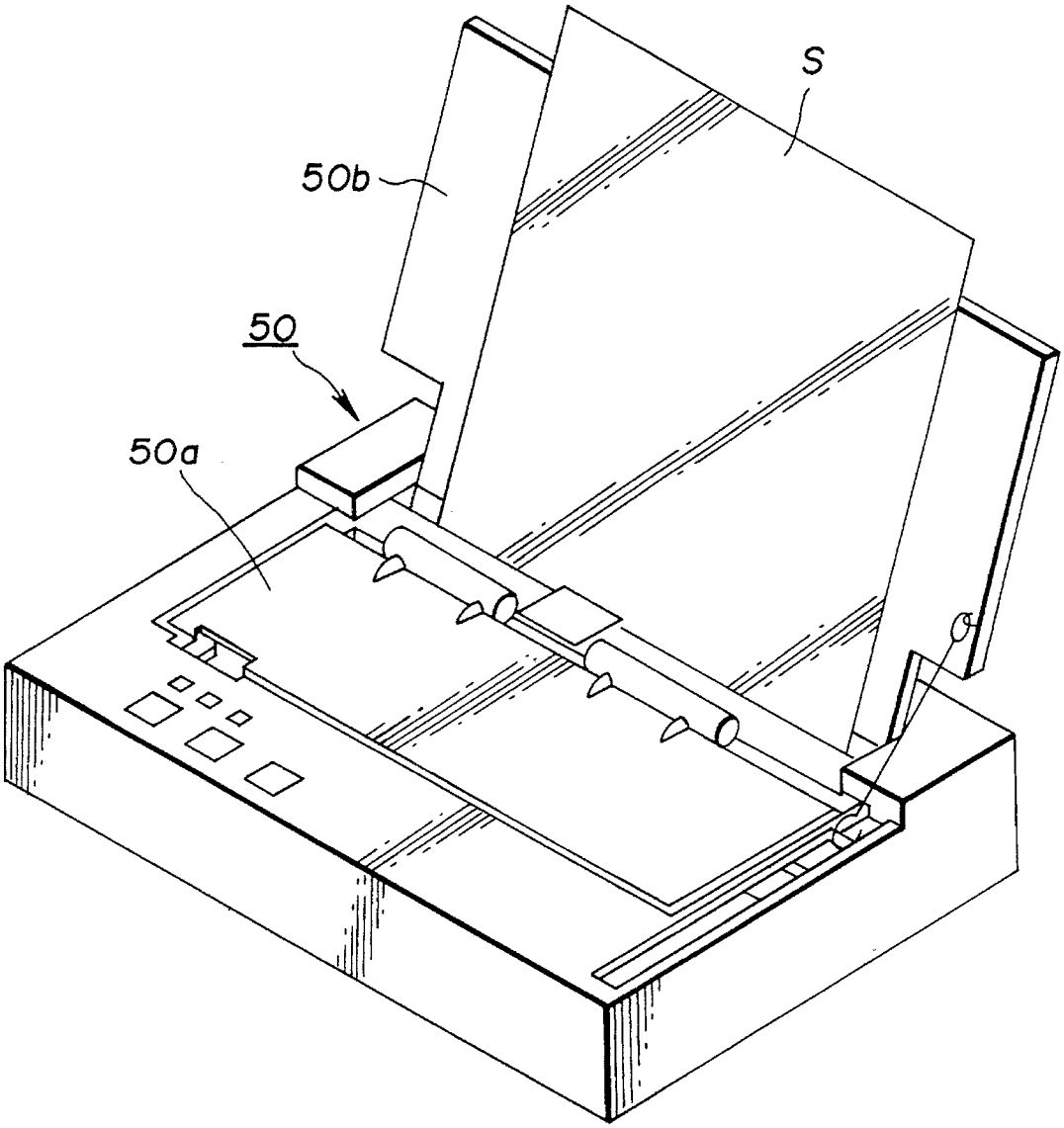
FIG.10 (PRIOR ART)
FIG. 10 is a perspective view of an external appearance of a conventional portable printer.
Figure 11:
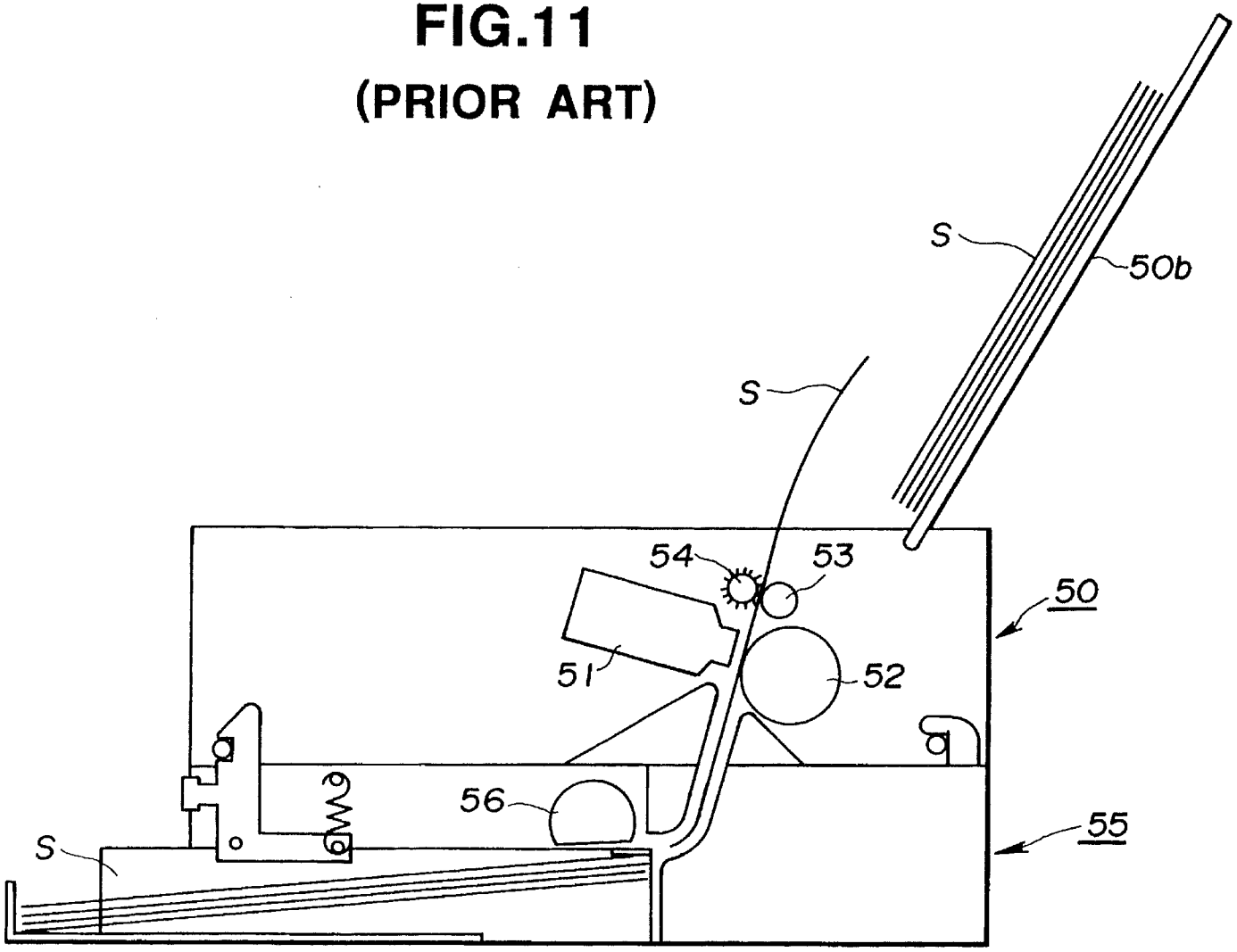
FIG.11 (PRIOR ART)
FIG. 11 is a sectional side view of a conventional recording apparatus provided with an automatic sheet-material feeding unit.
Figure 12:
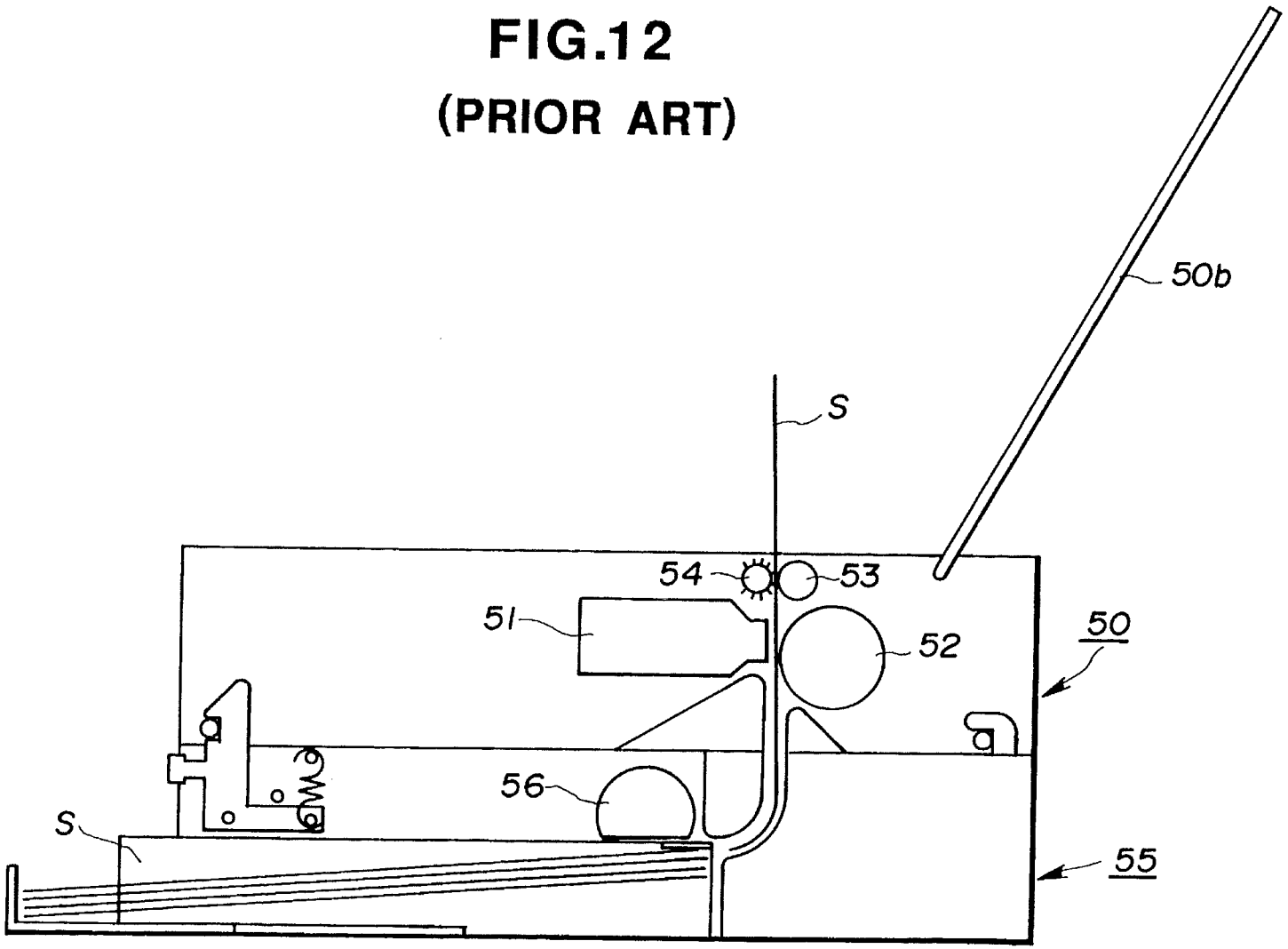
FIG.12 (PRIOR ART)
FIG. 12 is a sectional side view of another conventional recording apparatus provided with an automatic sheet-material feeding unit.

As shown in FIG. 9, a support 24 may be provided at a predetermined position on the inclined surface 2a of the automatic sheet-material feeding unit 2, and a notch (not shown) may be provided at a predetermined position of the mounting surface (the base) of the recording unit 1 so that when mounting the recording unit 1 on the automatic sheet-material feeding unit 2, the support 24 passes through the notch provided in the recording unit 1 and pushes the plane 23 including the operation unit 8 from below to support the plane 23 at a predetermined position around the fulcrum 23a.

As explained above, in the present invention, by providing an inclined surface, serving as an inclining means, in an automatic sheet-material feeding unit and mounting a recording apparatus on the inclined surface, a sheet-material feeding path within the recording apparatus is inclined. As a result, sheet material is smoothly fed from the automatic sheet-material feeding unit to the recording apparatus without imparing transportability of the recording apparatus, and the sheet material is securely discharged onto a discharge tray after a recording operation.

Furthermore, by providing an operation/display unit of the recording apparatus so as to be inclined in a direction reverse to the inclination of the recording apparatus, the operability and visibility of the apparatus is improved.

What is claimed is:

1. A recording apparatus comprising a recording unit for recording on a sheet, with an upper surface and a lower surface for a sheet feeding unit for supporting said recording unit and feeding the sheet to said recording unit, said recording unit comprising:

a conveying path substantially orthogonal to the lower surface and the upper surface of said recording unit;

conveying means for conveying the sheet received from said sheet feeding unit along said sheet conveying path;

recording means disposed along said sheet conveying path for performing recording on the sheet; and a tray for mounting the sheet conveyed by said conveying means, and said sheet feeding unit comprising:

feeding means for feeding the sheet from said sheet feeding unit to said sheet conveying path in said recording unit; and supporting means for supporting said recording unit so as to incline the upper surface of said recording unit during operation of the recording apparatus.

2. A recording apparatus according to claim 1, wherein said supporting means includes an inclined supporting surface formed on an upper portion of said sheet feeding unit.

3. A recording apparatus according to claim 1, wherein said supporting means includes a link for linking said recording unit to said sheet feeding unit.

4. A recording apparatus according to claim 1, wherein said tray is inclined and said supporting means inclines said recording unit so that the sheet is discharged onto said tray.

5. A recording apparatus according to claim 1, wherein said recording means records by discharging liquid drops of ink by thermal energy.

6. A recording apparatus according to claim 1, further comprising an operation unit for inputting information to said recording apparatus, said operation unit being inclined on a plane having an inclination reverse to the inclination of the upper surface of said recording unit in relation to a horizontal plane, during operation of said recording apparatus.

7. A recording apparatus for recording on a sheet, said recording apparatus dividable into a first section and a second section, comprising:

a sheet conveying path, extending from the first section to the second section;

recording means disposed in the second section along said sheet conveying path for performing recording on the sheet;

a sheet supporting member disposed in the first section;

conveying means for conveying the sheet from the sheet supporting member, along the sheet conveying path;

discharging means for discharging the sheet on which recording has been performed by said recording means in a direction substantially orthogonal to an upper surface of said recording apparatus;

a tray for mounting the sheet discharged by said discharging means; and supporting means for supporting the second section of said recording apparatus whereby the upper surface of the second section is inclined to further incline said tray and said discharging means so that the sheet is discharged onto said tray during operation of the recording apparatus.

8. A recording apparatus according to claim 7, wherein said supporting means includes a supporting surface for supporting the second section to hold said tray and said discharging means in an inclined state.

9. A recording apparatus according to claim 7, wherein said supporting means includes a link.

10. A recording apparatus according to claim 7, wherein said recording means records by discharging liquid drops of ink by thermal energy.

11. A recording apparatus according to claim 8, further comprising an operation unit on a plane having an inclination reverse to an inclination of said supporting means, said operation unit for inputting information to said recording apparatus.

12. A recording apparatus comprising a recording unit for recording on a sheet, with a lower surface and for recording on a sheet and a sheet feeding unit for supporting said recording unit and for feeding the sheet to said recording unit, said recording unit comprising:

conveying means for conveying the sheet;

recording means disposed opposed to said conveying means for performing recording on the sheet;

wherein said conveying means and said recording means are disposed along the lower surface of said recording unit;

said sheet feeding unit comprising;

feeding means for feeding the sheet to said conveying means in said recording unit; and a supporting member for supporting said recording unit so as to incline the lower surface of said recording unit during operation of the recording apparatus.

13. A recording apparatus according to claim 12, wherein said supporting member includes an inclined supporting surface formed on an upper portion of said sheet feeding unit.

14. A recording apparatus according to claim 12, wherein said supporting member includes a link for linking said recording unit to said sheet feeding unit.

15. A recording apparatus according to claim 12, wherein said recording unit further comprises a tray disposed on an upper portion of said recording unit for mounting the sheet conveyed by said conveying means.

16. A recording apparatus according to claim 15, wherein said supporting member inclines said tray so that the sheet conveyed by said conveying means falls on said tray.

17. A recording apparatus according to claim 12, wherein said recording means records by discharging liquid drops of ink by thermal energy.

18. A recording apparatus according to claim 15, wherein said recording unit includes a conveying path and said conveying means conveys the sheet along said conveying path.

19. A recording apparatus according to claim 18, wherein said supporting member inclines said conveying path.

20. A recording apparatus according to claim 19, wherein the supporting member inclines said tray so that the sheet conveyed by said conveying means falls on said tray.

21. A recording apparatus according to claim 18, wherein said conveying path is substantially orthogonal to said lower surface of said recording unit.

* * * * *

UNITED STATES PATENT AND TRADEMARK OFFICE

CERTIFICATE OF CORRECTION

PATENT NO. : 5,499,043

DATED : March 12, 1996

INVENTOR(S) : TSUTOMU OSAKA

It is certified that error appears in the above-indentified patent and that said Letters Patent is hereby corrected as shown below:

COLUMN 1

Line 36, "printer 80" should read --printer 50--.

COLUMN 2

Line 65, "FIG. 8" should read --FIG. 6--.

COLUMN 4

Line 36, "for" (first occurrence) should be deleted.

--

UNITED STATES PATENT AND TRADEMARK OFFICE

CERTIFICATE OF CORRECTION

PATENT NO. : 5,499,043 Page 2 of 2

DATED : March 12, 1996

INVENTOR(S) : TSUTOMU OSAKA

It is certified that error appears in the above-indentified patent and that said Letters Patent is hereby corrected as shown below:

COLUMN 6

Line 42, "for" (first occurrence) should read --and--.
Line 43, "feeding" should read --for feeding--.

COLUMN 8

Line 2, "and for recording" should be deleted.
Line 3, "one a sheet" should be deleted.

Signed and Sealed this

Twenty-seventh Day of August, 1996

Bruce Lehman

*Attest:*

BRUCE LEHMAN

*Attesting Officer*

*Commissioner of Patents and Trademarks*